US008581592B2

(12) United States Patent
Bittar et al.

(10) Patent No.: US 8,581,592 B2
(45) Date of Patent: Nov. 12, 2013

(54) DOWNHOLE METHODS AND ASSEMBLIES EMPLOYING AN AT-BIT ANTENNA

(75) Inventors: Michael S. Bittar, Houston, TX (US); Clive D. Menezes, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/919,426

(22) PCT Filed: Dec. 16, 2008

(86) PCT No.: PCT/US2008/087021

§ 371 (c)(1), (2), (4) Date: Aug. 25, 2010

(87) PCT Pub. No.: WO2010/074678

PCT Pub. Date: Jul. 1, 2010

(65) Prior Publication Data

US 2011/0234230 A1 Sep. 29, 2011

(51) Int. Cl.
*G01V 3/08* (2006.01)
*G01V 3/10* (2006.01)

(52) U.S. Cl.
USPC ..... 324/338; 324/343

(58) Field of Classification Search
USPC ..... 324/338–343
See application file for complete search history.

(56) References Cited

U.S. PATENT DOCUMENTS 2,901,689 A 8/1959 Barrett
3,014,177 A 12/1961 Hungerford et al.
3,187,252 A 6/1965 Hungerford
3,305,771 A * 2/1967 Arps ..... 324/342
3,408,561 A * 10/1968 Osborn et al. ..... 324/342
3,510,757 A 5/1970 Huston (Continued)

FOREIGN PATENT DOCUMENTS

EP 527089 2/1993
EP 0654687 5/1995

(Continued)

OTHER PUBLICATIONS

Bell, C. et al., "Navigating and Imaging in Complex Geology With Azimuthal Propagation Resistivity While Drilling", 2006 SPE Annual Technical Conference and Exhibition, SPE 102637, San Antonio, TX, USA, (Sep. 24, 2006),pp. 1-14.

(Continued)

*Primary Examiner* — Jay Patidar
(74) *Attorney, Agent, or Firm* — Krueger Iselin LLP; Benjamin Fite

(57) ABSTRACT

Logging tools and methods employing an at-bit loop antenna to acquire azimuthal resistivity measurements proximate to the bit enable low-latency geosteering signals to be generated. In some embodiments, the at-bit antenna is part of a bottom hole assembly that includes a drill bit, a mud motor, and a resistivity tool. The mud motor is positioned between the at-bit antenna and the resistivity tool. The resistivity tool includes at least one loop antenna that is not parallel to the at-bit loop antenna. The at-bit antenna is part of an at-bit module that, in some embodiments, transmits periodic electromagnetic signal pulses for the resistivity tool to measure. In other embodiments, the at-bit module measures characteristics of electromagnetic signal pulses sent by the resistivity tool and communicates the measured characteristics to the resistivity tool via a short hop telemetry link.

20 Claims, 4 Drawing Sheets

(56) References Cited

U.S. PATENT DOCUMENTS 3,539,911 A 11/1970 Youmans et al.
3,808,520 A 4/1974 Runge
3,982,176 A 9/1976 Meador
4,302,722 A 11/1981 Gianzero
4,319,191 A 3/1982 Meador et al.
4,360,777 A 11/1982 Segesman
4,536,714 A 8/1985 Clark
4,553,097 A 11/1985 Clark
4,610,313 A 9/1986 Daly et al.
4,611,173 A 9/1986 Bravenec et al.
4,636,731 A 1/1987 Savage et al.
4,651,101 A 3/1987 Barber et al.
4,697,190 A 9/1987 Oswald
4,700,142 A 10/1987 Kuckes
4,780,857 A 10/1988 Lyle et al.
4,785,247 A 11/1988 Meador et al.
4,791,373 A 12/1988 Kuckes
4,808,929 A 2/1989 Oldigs
RE32,913 E 4/1989 Clark
4,845,433 A 7/1989 Kleinberg et al.
4,849,699 A * 7/1989 Gill et al. ..... 324/339
4,873,488 A 10/1989 Barber et al.
4,899,112 A 2/1990 Clark et al.
4,933,640 A 6/1990 Kuckes
4,940,943 A 7/1990 Bartel et al.
4,945,987 A 8/1990 Wittrisch
4,949,045 A 8/1990 Clark et al.
4,962,490 A 10/1990 Lyle et al.
4,980,643 A 12/1990 Gianzero et al.
5,089,779 A 2/1992 Rorden
5,115,198 A 5/1992 Gianzero et al.
5,160,925 A 11/1992 Dailey et al.
5,200,705 A 4/1993 Clark et al.
5,210,495 A 5/1993 Hapashy et al.
5,230,386 A 7/1993 Wu et al.
5,239,448 A 8/1993 Perkins et al.
5,241,273 A 8/1993 Luling
5,243,290 A 9/1993 Safinya
5,260,662 A 11/1993 Rorden
5,278,507 A 1/1994 Bartel et al.
5,329,448 A 7/1994 Rosthal
5,332,048 A 7/1994 Underwood et al.
5,389,881 A 2/1995 Bittar et al.
5,402,068 A 3/1995 Meador et al.
5,424,293 A 6/1995 Zoller et al.
5,428,293 A 6/1995 Sinclair et al.
5,442,294 A 8/1995 Rorden
5,448,227 A 9/1995 Orban et al.
5,475,309 A 12/1995 Hong et al.
5,485,089 A 1/1996 Kuckes
5,501,285 A 3/1996 Lamine et al.
5,508,616 A 4/1996 Sato et al.
5,530,358 A 6/1996 Wisler et al.
5,550,473 A 8/1996 Klein
5,563,512 A 10/1996 Mumby
5,589,775 A 12/1996 Kuckes
5,594,343 A 1/1997 Clark et al.
5,602,541 A 2/1997 Comeau et al.
5,656,930 A 8/1997 Hagiwara
5,720,355 A 2/1998 Lamine et al.
5,725,059 A 3/1998 Kuckes et al.
5,757,191 A 5/1998 Gianzero
5,781,436 A 7/1998 Forgang et al.
5,813,480 A 9/1998 Zaleski, Jr. et al.
5,854,991 A 12/1998 Gupta et al.
5,864,058 A 1/1999 Chen-Kang
5,886,526 A 3/1999 Wu
5,892,460 A 4/1999 Jerabek et al.
5,923,170 A 7/1999 Kuckes
5,999,883 A 12/1999 Gupta et al.
6,044,325 A 3/2000 Chakravarthy et al.
6,057,784 A 5/2000 Schaaf et al.
6,147,496 A 11/2000 Strack et al.
6,150,822 A 11/2000 Hong et al.
6,158,532 A 12/2000 Logan et al.
6,163,155 A 12/2000 Bittar
6,181,138 B1 1/2001 Hagiwara et al.
6,188,222 B1 * 2/2001 Seydoux et al. ..... 324/339
6,191,586 B1 2/2001 Bittar
6,218,841 B1 4/2001 Wu
6,218,842 B1 4/2001 Bittar
6,230,822 B1 5/2001 Sullivan et al.
6,297,639 B1 10/2001 Clark et al.
6,304,086 B1 10/2001 Minerbo et al.
6,351,127 B1 2/2002 Rosthal et al.
6,353,321 B1 3/2002 Bittar
6,359,438 B1 3/2002 Bittar
6,373,254 B1 4/2002 Dion et al.
6,466,020 B2 10/2002 Kuckes et al.
6,476,609 B1 11/2002 Bittar
6,538,447 B2 3/2003 Bittar
6,540,033 B1 4/2003 Sullivan et al.
6,541,979 B2 4/2003 Omeragic
6,543,312 B2 4/2003 Sullivan et al.
6,566,881 B2 5/2003 Omeragic et al.
6,571,886 B1 6/2003 Sullivan
6,573,722 B2 6/2003 Rosthal et al.
6,614,229 B1 9/2003 Clark et al.
6,626,251 B1 9/2003 Sullivan et al.
6,648,082 B2 11/2003 Schultz et al.
6,691,802 B2 2/2004 Schultz et al.
6,698,536 B2 3/2004 Moran et al.
6,710,600 B1 3/2004 Kopecki et al.
6,736,222 B2 5/2004 Kuckes et al.
6,777,940 B2 8/2004 Macune
6,778,127 B2 8/2004 Stolarczyk et al.
6,810,331 B2 10/2004 Bittar et al.
6,814,162 B2 11/2004 Moran et al.
6,850,068 B2 2/2005 Chemali et al.
6,863,127 B2 3/2005 Clark et al.
6,885,943 B2 4/2005 Bittar et al.
6,900,640 B2 5/2005 Fanini et al.
6,911,824 B2 6/2005 Bittar
6,944,546 B2 9/2005 Xiao et al.
7,017,662 B2 3/2006 Schultz et al.
7,019,528 B2 3/2006 Bittar
7,038,455 B2 5/2006 Beste et al.
7,046,010 B2 5/2006 Hu et al.
7,066,280 B2 6/2006 Sullivan et al.
7,075,455 B2 7/2006 Nishimura et al.
7,138,803 B2 11/2006 Bittar
7,207,215 B2 4/2007 Spross et al.
7,227,363 B2 6/2007 Gianzero et al.
7,265,552 B2 9/2007 Bittar
7,316,277 B2 1/2008 Jeffryes
7,394,257 B2 7/2008 Martinez et al.
7,557,582 B2 * 7/2009 Moore ..... 324/347
7,786,731 B2 * 8/2010 Cole et al. ..... 324/326
7,786,733 B2 * 8/2010 Seydoux et al. ..... 324/334
8,274,289 B2 9/2012 Bittar et al.
8,347,985 B2 1/2013 Bittar et al.
2003/0051914 A1 3/2003 Bittar
2003/0055565 A1 3/2003 Omeragic
2003/0062197 A1 4/2003 Moran et al.
2003/0076107 A1 4/2003 Fanini et al.
2004/0090234 A1 * 5/2004 Macune ..... 324/337
2004/0196047 A1 10/2004 Fanini et al.
2005/0006090 A1 1/2005 Chemali et al.
2005/0024060 A1 2/2005 Bittar
2005/0083063 A1 4/2005 Omeragic et al.
2005/0140373 A1 6/2005 Li et al.
2005/0218898 A1 10/2005 Fredette et al.
2006/0011385 A1 1/2006 Seydoux et al.
2006/0015256 A1 1/2006 Hassan et al.
2006/0125479 A1 6/2006 Chemali et al.
2006/0244455 A1 11/2006 Bittar
2006/0272859 A1 12/2006 Pastusek et al.
2007/0186639 A1 8/2007 Spross et al.
2007/0272442 A1 11/2007 Pastusek et al.
2007/0278008 A1 12/2007 Kuckes et al.
2008/0078580 A1 4/2008 Bittar
2008/0136419 A1 6/2008 Seydoux et al.
2008/0297161 A1 * 12/2008 Gorek ..... 324/342
2009/0015260 A1 1/2009 Bittar

(56) References Cited

U.S. PATENT DOCUMENTS

| | | | | |
|---|---|---|---|---|
| 2009/0230968 | A1 | 9/2009 | Bittar et al. | |
| 2010/0127708 | A1 | 5/2010 | Bittar | |
| 2011/0133740 | A1* | 6/2011 | Seydoux et al. | 324/338 |
| 2011/0180327 | A1 | 7/2011 | Bittar et al. | |
| 2011/0234230 | A1 | 9/2011 | Bittar et al. | |

FOREIGN PATENT DOCUMENTS

| | | | |
|---|---|---|---|
| EP | 0814349 | A2 | 12/1997 |
| EP | 9800733 | | 1/1998 |
| EP | 0840142 | A2 | 5/1998 |
| EP | 093519 | | 7/1999 |
| FR | 2 699 286 | | 6/1994 |
| GB | 2 279 149 | | 12/1994 |
| RU | 2279697 | | 10/2003 |
| RU | 2305300 | | 8/2007 |
| WO | WO-9531736 | | 11/1995 |
| WO | WO-00/41006 | | 7/2000 |
| WO | WO-0050926 | | 8/2000 |
| WO | WO-0155748 | | 8/2001 |
| WO | WO-03/069120 | | 8/2003 |
| WO | WO-2006/030489 | | 12/2007 |
| WO | WO-2008/021868 | | 2/2008 |
| WO | WO-2009029517 | | 3/2009 |
| WO | WO-2009/073008 | | 6/2009 |
| WO | WO-2010/074678 | | 7/2010 |

OTHER PUBLICATIONS

Bittar, Michael S., "A New Azimuthal Deep-Reading Resistivity Tool for Geosteering and Advanced Formation Evaluation", 2007 SPE Annual Technical Conference and Exhibition, SPE 109971, Anaheim, CA, USA, (Nov. 11, 2007),pp. 1-9.

Bittar, Michael S., "Processing Resistivity Logs", U.S. Appl. No. 60/821,721, filed Aug. 8, 2006.

Bittar, Michael S., "Tool for Azimuthal Resistivity Measurement and Bed Boundary Detection", U.S. Appl. No. 60/821,988, filed Aug. 10, 2006.

Bittar, Michael S., "Resistivity Logging with Reduced Dip Artifacts", PCT Appl No. US2007/075455, filed Aug. 8, 2006.

Bittar, Michael S., et al., "A True Multiple Depth of Investigation Electromagnetic Wave Resistivity Sensor: Theory, Experiment, and Prototype Field Test Results", SPE 22705, 66th Annual Technical Conference and Exhibition of the SPE, Dallas, TX, (Oct. 6, 1991), pp. 1-8, plus 10 pgs of Figures.

Bittar, Michael S., et al., "Invasion Profiling with a Multiple Depth of Investigation, Electromagnetic Wave Resistivity Sensor", SPE 28425, 69th Annual Technical Conference and Exhibition of the SPE, New Orleans, LA, (Sep. 25, 1994),pp. 1-12, plus 11 pgs of Figures.

Bittar, Michael S., et al., "The Effects of Rock Anisotropy on MWD Electromagnetic Wave Resistivity Sensors", The Log Analyst, (Jan. 1996), pp. 20-30.

Bittar, Michael S., et al., "The Effects of Rock Anisotropy on MWD Electromagnetic Wave Resistivity Sensors", SPWLA 35th Annual Logging Symposium, (Jun. 19, 1994), 18 pgs.

Bonner, S. et al., "A New Generation of Electrode Resistivity Measurements for Formation Evaluation While Drilling", SPWLA 35th Annual Logging Symposium, (Jun. 19, 1994), pp. 1-19.

Bonner, Steve et al., "Measurements at the Bit: A New Generation of MWD Tools", Oilfield Review, (Apr. 1993), pp. 44-54.

Canadian Office Action, dated Jan. 23, 2009, Application No. 2,415,563, "Electromagnetic Wave Resistivity Tool With a Tilted Antenna", filed Jan. 10, 2001, 3 pgs.

Canadian Office Action, dated Jan. 29, 2007, Application No. 2,415,563, "Electromagnetic Wave Resistivity Tool With a Tilted Antenna", filed Jul. 10, 2001, 4 pgs.

Canadian Office Action, dated Jun. 7, 2005, Application No. 2,415,563, "Electromagnetic Wave Resistivity Tool With a Tilted Antenna", filed Jul. 10, 2001, 2 pgs.

Canadian Office Action, dated Jul. 21, 2003, Appl No. 2,359,371, "Electromagnetic Wave Resistivity Tool Having a Tilted Antenna for Determining the Horizontal and Vertical Resistivities and Relative Dip Angle in Anisotropic Earth Formations", Jan. 24, 2000, 1 pg.

Canadian Office Action, dated Nov. 1, 2007, Application No. 2,415,563, "Electromagnetic Wave Resistivity Tool With a Tilted Antenna", filed Jan. 10, 2001, 5 pgs.

Clark, Brian et al., "A Dual Depth Resistivity Measurement for Fewd", SPWLA 29th Annual Logging Symposium, (Jun. 1988), 25 pgs.

Clark, Brian et al., "Electromagnetic Propagation Logging While Drilling: Theory and Experiment", SPE Formation Evaluation, (Sep. 1990), pp. 263-271.

European Office Action, dated Jul. 17, 2006, Appl No. 01962294.3, "Electromagnetic Wave Resistivity Tool Having a Tilted Antenna for Determining the Horizontal and Vertical Resistivities and Relative Dip Angle in Anisotropic Earth Form . . . ", filed Jul. 10, 2001, 2 pgs.

European Office Action, dated Apr. 29, 2008, Application No. 00908351.0, "Electromagnetic Wave Resistivity Tool Having Tilted Antenna", filed Jan. 24, 2000, 5 pgs.

European Office Action, dated Jul. 17, 2006, Appl No. 01 096 294.3 , "Electromagnetic Wave Resistivity Tool Having a Tilted Antenna for Determining the Horizontal and Vertical Resistivities and Relative Dip Angle in Anisotropic Earth Formations", Jul. 10, 2001, 2 pgs.

European Office Action, dated Jul. 31, 2007, Appl No. 00908351.0, "Electromagnetic Wave Resistivity Tool Having a Tilted Antenna for Determining the Horizontal and Vertical Resistivities and Relative Dip Angle in Anisotropic Earth Formations" filed Jan. 24, 2000, 5 pgs.

European Office Action, dated Jul. 31, 2007, Application No. 00908351.0, "Electromagnetic Wave Resistivity Tool Having Tilted Antenna", filed Jan. 24, 2000, 42 pgs.

European Office Action, dated Sep. 13, 2007, Appl No. 01962294.3, "Electromagnetic Wave Resistivity Tool Having a Tilted Antenna for Determining the Horizontal and Vertical Resistivities and Relative Dip Angle in Anisotropic Earth Formations", filed Jul. 10, 2001, 4 pgs.

European Office Action, dated Sep. 23, 3008, Appl No. 01096 294.3, "Electromagnetic wave resistivity tool having a tilted antenna for determining the horizontal and vertical resistivities and relative dip angle in anisotropic earth formations", Jul. 10, 2001, 4 pgs.

European Supplemental Search Report, dated Jun. 12, 2003 Appl No. 00908351.0, "Electromagnetic Wave Resistivity Tool Having a Tilted Antenna for Determining the Horizontal and Vertical Resistivities and Relative Dip Angle in Anisotropic Earth Formations", Jan. 24, 2000, 2 pgs.

Eurpoean Office Action, dated Sep. 27, 2005, Appl No. 01962294.3, "Electromagnetic Wave Resistivity Tool Having a Tilted Antenna for Determining the Horizontal and Vertical Resistivities and Relative Dip Angle in Anisotropic Earth Formations", filed Jul. 10, 2001, 5 pgs.

Finger, J. T., et al., "Development of a System for Diagnostic-While-Drilling (DWD)", SPE/IADC Drilling Conference, SPE/IADC 79884, Amsterdam, The Netherlands, (Feb. 19, 2003), 9 pgs.

Hagiwara, T. "A New Method to Determine Horizontal-Resistivity in Anisotropic Formations Without Prior Knowledge of Relative Dip", 37th Annual SPWLA Logging Symposium, New Orleans, LA, (Jun. 16, 1996),pp. 1-5, plus 3 pgs of Figs.

Halliburton Energy Services, Inc, "Sperry Drilling Services Facilities", Houston, TX, www.Halliburton.com, (Nov. 11, 2008), pp. 1-5.

Hayes, Dan "Steering into New Horizons", E&P Magazine, http://www.epmag.com/archives/print/4052.htm, (Jun. 1, 2000), pp. 1-3.

Li, Qiming et al., "New Directional Electromagnetic Tool for Proactive Geosteering and Accurate Formation Evaluation While Drilling", SPWLA 46th Annual Logging Symposium, New Orleans, LA, USA, (Jun. 26, 2005), 16 pgs.

Luling, M. et al., "Processing and Modeling 2-MHz Resistivity Tools in Dipping, Laminated, Anisotropic Formations: SPWLA", SPWLA 35th Annual Logging Symposium, paper QQ, (1994), pp. 1-25.

Mack, S. G., et al., "MWD Tool Accurately Measures Four Resistivities", Oil & Gas Journal, (May 25, 1992), pp. 1-5.

Mechetin, V. F., et al., "Temp—A New Dual Electromagnetic and Laterolog Apparatus—Technological Complex", All-Union Research Logging Institute, Ufa, USSR. Ch. Ostrander, Petro Physics Int'l, Dallas, Texas, USA, (Date Unknown), 17 pgs.

(56) References Cited

OTHER PUBLICATIONS

Meyer, W. H., "New Two Frequency Propagation Resistivity Tools", SPWLA 36th Annual Logging Symposium, (Jun. 26-29, 1995),12 pgs.
No Office Action, dated Apr. 3, 2009, Application No. 2001 3707, "Electromagnetic Wave Resistivity Tool Having a Tilted Antenna for Determining the Horizontal and Vertical Resistivities and Relative Dip Angle in Anisotropic Earth Formations", filed Jan. 24, 2000, 5 pgs.
PCT International Preliminary Examination Report, dated Nov. 4, 2002, Appl No. PCT/US01/41319 "Electromagnetic Wave Resistivity Tool Having a Tilted Antenna for Geosteering Within a Desired Payzone", filed Jul. 10, 2001, 30 pgs.
PCT International Search Report and Written Opinion, dated Feb. 10, 2009, Appl No. PCT/US08/87021, "Azimuthal At-Bit Resistivity and Geosteering Methods and Systems", filed Dec. 16, 2008, 9 pgs.
PCT International Search Report and Written Opinion, dated May 15, 2000, Appl No. PCT/US00/01693, "Electromagnetic Wave Resistivity Tool Having a Tilted Antenna for Determining the Horizontal and Vertical Resistivities and Relative Dip Angle in Anisotropic Earth Formations", Jan. 24, 2000, 38 pgs.
PCT International Search Report and Written Opinion, dated Jun. 27, 2008, Appl No. PCT/US08/51447, "EM-Guided Drilling Relative to an Existing Borehole", 8 pgs.
PCT International Search Report, dated Jan. 31, 2008, Appl No. PCT/US07/15806, "Modular Geosteering Tool Assembly", filed Jul. 11, 2007, 27 pgs.
PCT International Search Report, dated Feb. 5, 2008, Appl No. PCT/US07/64221, "Robust Inversion Systems and Methods for Azimuthally Sensitive Resistivity Logging Tools", filed Mar. 16, 2007, 1 pg.
PCT International Search Report, dated Feb. 27, 2008, Appl No. PCT/US07/75455, "Resistivity Logging with Reduced Dip Artifacts", filed Aug. 8, 2007, 18 pgs.
PCT International Search Report, dated Apr. 30, 2008, Appl No. PCT/US06/62149, "Antenna Coupling Component Measurement Tool Having a Rotating Antenna Configuration", filed Dec. 15, 2006, 3 pgs.
PCT International Search Report, dated May 15, 2002, Appl No. PCT/US00/01693, "Electromagnetic Wave Resistivity Tool Having a Tilted Antenna for Determining the Horizontal and Vertical Resistivities and Relative Dip Angle in Anisotropic Earth Formations", Jan. 24, 2000, 4 pgs.
PCT International Search Report, dated May 15, 2008, Appl No. PCT/US07/15744, "Method and Apparatus for Building a Tilted Antenna", filed Jul. 11, 2007, 2 pgs.
PCT International Search Report, dated Sep. 18, 2001, Appl No. US01/41319, "Electromagnetic Wave Resistivity Tool Having a Tilted Antenna for Determining the Horizontal and Vertical Resistivities and Relative Dip Angle in Anisotropic Earth Formations", Aug. 6, 2002, 5 pgs.
PCT Written Opinion, dated Aug. 6, 2002, Appl No. PCT/US01/41319, "Electromagnetic Wave Resistivity Tool Having a Tilted Antenna for Geosteering Within a Desired Payzone", filed Jul. 10, 2001, 5 pgs.
Pitcher, J. et al., "A New Azimuthal Gamma at Bit Imaging Tool for Geosteering", SPE/IADC Drilling Conference and Exhibition, SPE/IADC 118328, Amsterdam, The Netherlands, (Mar. 17, 2009), pp. 1-8.
Roberts, T. S., et al., "Optimization of PDC Drill Bit Performance Utilizing High-Speed, Real-Ti9me Downhole Data Acquired Under a Cooperative Research and Development Agreement", SPE/IADC Drilling Conference, SPE/IADC 91782, Amsterdam, The Netherlands, (Feb. 23, 2005), 14 pgs.
Rodney, Paul F., et al., "Electromagnetic Wave Resistivity MWD Tool", SPE Drilling Engineering, (Oct. 1986), pp. 37-346.
Russian Office Action, dated Jul. 9, 2009, Appl No. 2009104466, "Modular Geosteering Toll Assembly", filed Feb. 10, 2009, 8 pgs.
US Advisory Action, dated Apr. 13, 2007, U.S. Appl. No. 11/457,709, "Electromagnetic Wave Resistivity Tool Having a Tilted Antenna for Geosteering Within a Desired Payzone", filed Jul. 14, 2006, 3 pgs.
US Advisory Action, dated Sep. 15, 2005, U.S. Appl. No. 10/616,429, "Electromagnetic Wave Resistivity Tool Having a Tilted Antenna for Geosteering Within a Desired Payzone", filed Jul. 9, 2003, 14 pgs.
US Final Office Action, dated Jan. 19, 2007, U.S. Appl. No. 11/457,709, "Electromagnetic Wave Resistivity Tool Having a Tilted Antenna for Geosteering Within a Desired Payzone", filed Jul. 14, 2006, 31 pgs.
US Final Office Action, dated Jun. 6, 2005, U.S. Appl. No. 10/616,429, "Electromagnetic WaveResistivity Tool Having a Tilted Antenna for Geosteering Within a Desired Payzone", filed Jul. 9, 2003, 27 pgs.
US Final Office Action, dated Jun. 16, 2004, U.S. Appl. No. 10/255,048, "Electromagnetic Wave Resistivity Tool Having a Tilted Antenna for Determining the Horizontal and Vertical Resistivities and Relative Dip Angle in Anisotropic Earth Formations", Sep. 25, 2002, 8 pgs.
US Non-Final Office Action, dated Feb. 24, 2009, U.S. Appl. No. 12/127,634, "Electromagnetic Wave Resistivity Tool Having a Tilted Antenna for Determining the Horizontal and Vertical Resistivities and Relative Dip Angle in Anisotropic Earth Formations", filed May 27, 2008, 29 pgs.
US Non-Final Office Action, dated Apr. 26, 2000, Appl No. 09/23832, "Electromagnetic Wave Resistivity Tool Having a Tilted Antenna for Determining the Horizontal and Vertical Resistivities and Relative Dip Angle in Anisotropic Earth Formations", filed Jan. 28, 1999, 8 pgs.
US Non-Final Office Action, dated Jul. 28, 2003, U.S. Appl No. 10/255,048, "Electromagnetic Wave Resistivity Tool Having a Tilted Antenna for Determining the Horizontal and Vertical Resistivities and Relative Dip Angle in Anisotropic Earth Formations", Sep. 25, 2002, 6 pgs.
US Non-Final Office Action, dated Aug. 18, 2006, U.S. Appl. No. 11/457,709, "Electromagnetic Wave Resistivity Tool Having a Tilted Antenna for Geosteering Within a Desired Payzone", filed Jul. 14, 2006, 13 pgs.
US Non-Final Office Action, dated Aug. 26, 2004, Application No. 10/616,429, "Electromagnetic Wave Resistivity Tool Having a Tilted Antenna for Geosteering Within a Desired Payzone", filed Jul. 9, 2003, 11 pgs.
US Non-Final Office Action, dated Sep. 6, 2007, U.S. Appl. No. 11/745,822, "Electromagnetic Wave Resistivity Tool Having a Tilted Antenna for Geosteering Within a Desired Payzone", filed May 8, 2007, 31 pgs.
US Non-Final Office Action, dated Dec. 21, 2005, U.S. Appl. No. 11/198,066, "Electromagnetic Wave Resistivity Tool Having a Tilted Antenna for Determing the Horizontal and Vertical Resistivities and Relative Dip Angle in Anisotropic Earth", filed Aug. 5, 2005, 15 pgs.
Zhu, Tianfei et al., "Two Dimensional Velocity Inversion and Synthetic Seismogram Computation", Geophysics, vol. 52, No. 1, (Jan. 1987), pp. 37-49.
Australian First Examiner's Report, dated Sep. 7, 2011, Appl No. 2008365630, "Azimuthal At-Bit Resistivity and Geosteering Methods and Systems", filed Dec. 16, 2008, 2 pgs.
Bittar, Michael S., "Tool for Azimuthal Resistivity Measurement and Bed Boundary Detection", U.S. Appl. No. 60/821,988, filed Aug. 10, 2006, 12 pgs.
PCT International Prelimary Report on Patentability, dated May 10, 2012, Appl No. PCT/US08/87021, Azimuthal At-Bit Resistivity and Geosteering Methods and Systems, filed Dec. 16, 2008, 13 pgs.
U.S. Final Office Action, dated Feb. 22, 2011, U.S. Appl. No. 12/689,435, "Tool for Azimuthal Resistivity Measurement and Bed Boundary Detection" filed Jan. 19, 2010, 10 pgs.
US Non-Final Office Action, dated Apr. 16, 2012, U.S. Appl. No. 12/689,435, "Tool for Azimuthal Resistivity Measurement and Bed Boundary Detection", filed Jan. 19, 2010, 6 pgs.
US Non-Final Office Action, dated Jan. 11, 2013, U.S. Appl. No. 12/689,435, "Tool for Azimuthal Resistivity Measurement and Bed Boundary Detection", filed Jan. 19, 2010, 6 pgs.

* cited by examiner

FIG. 1
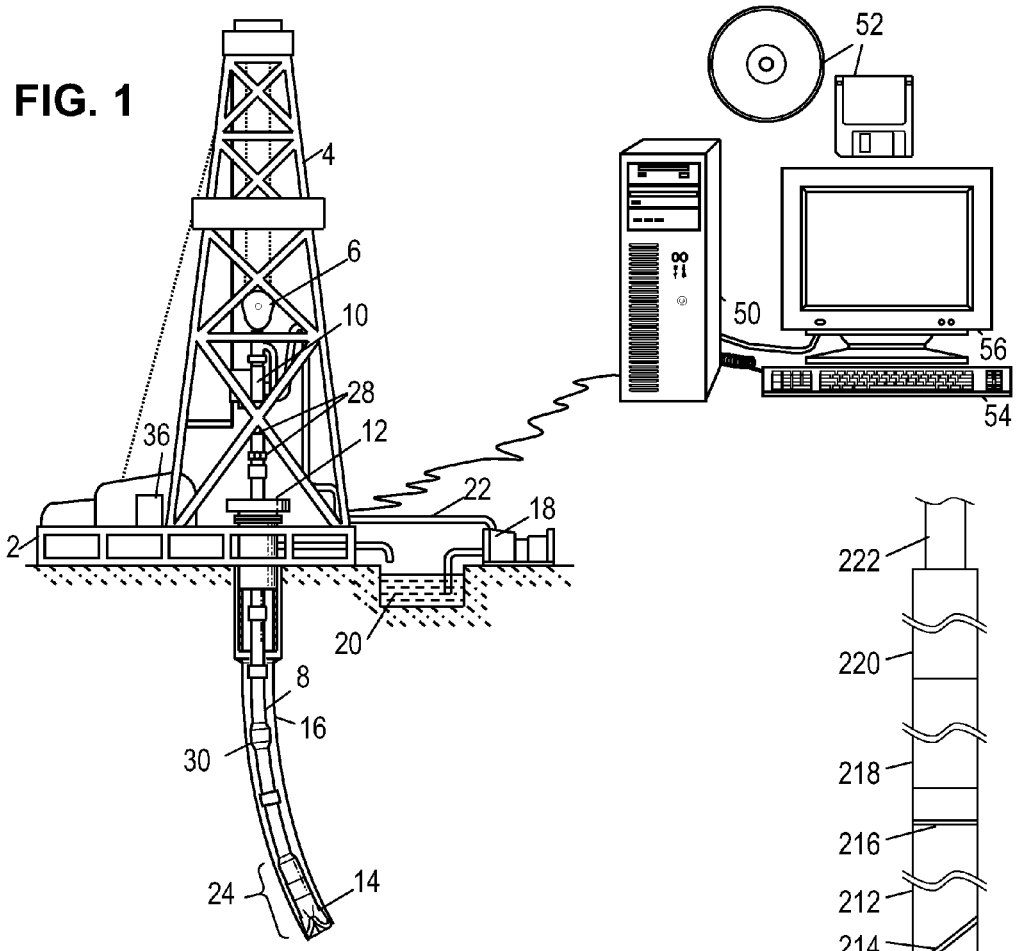
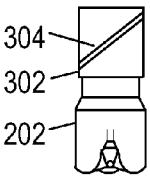
FIG. 3A
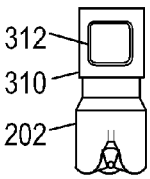
FIG. 3C
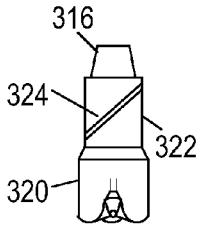
FIG. 3E
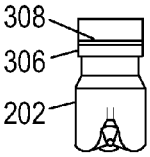
FIG. 3B
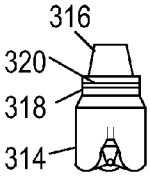
FIG. 3D
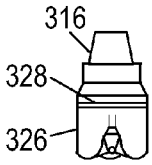
FIG. 3F
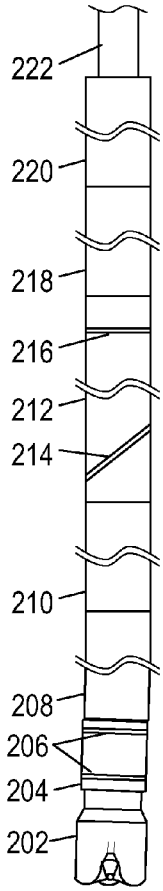
FIG. 2

FIG. 5
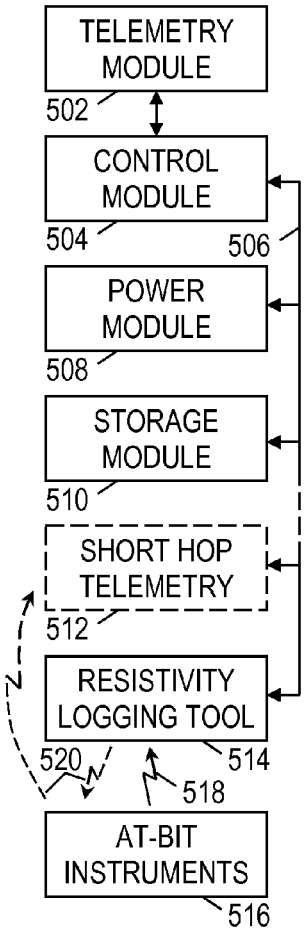
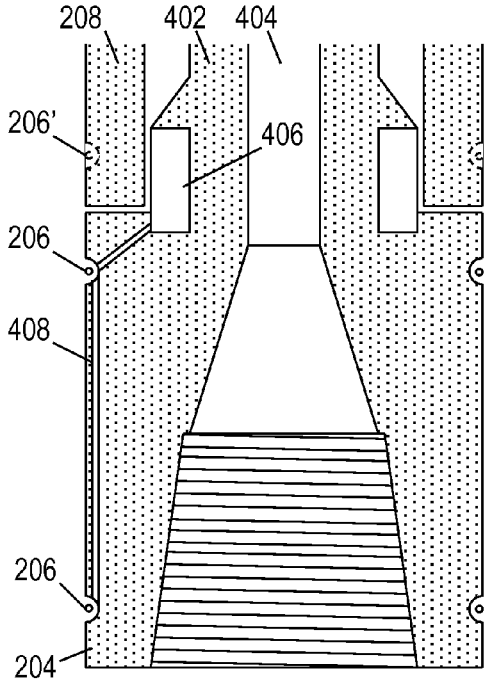
FIG. 4
FIG. 6
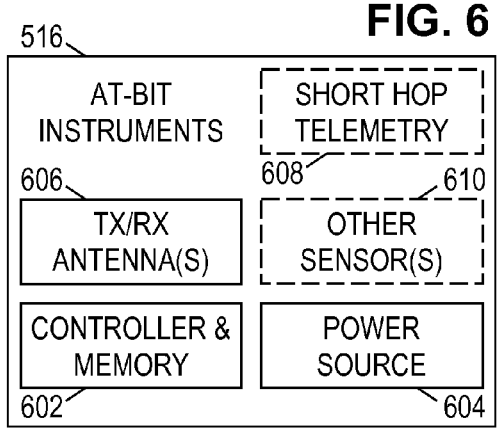

FIG. 7
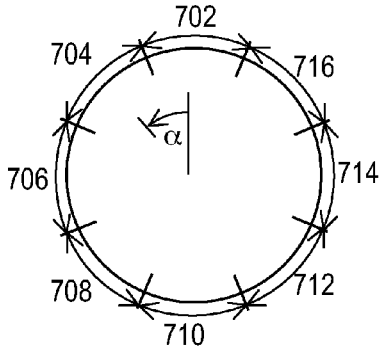
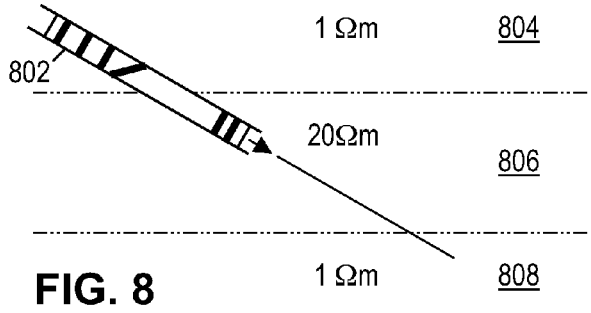
FIG. 8
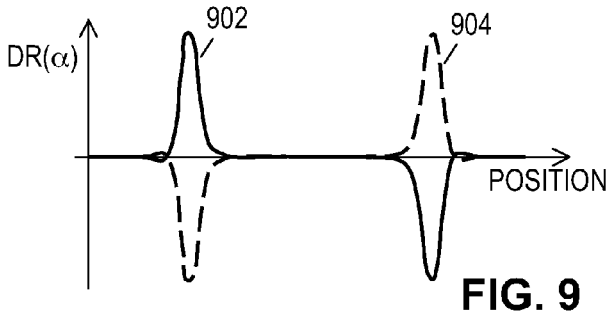
FIG. 9
FIG. 10
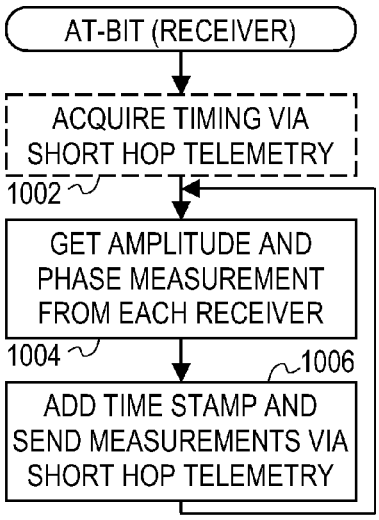
FIG. 11
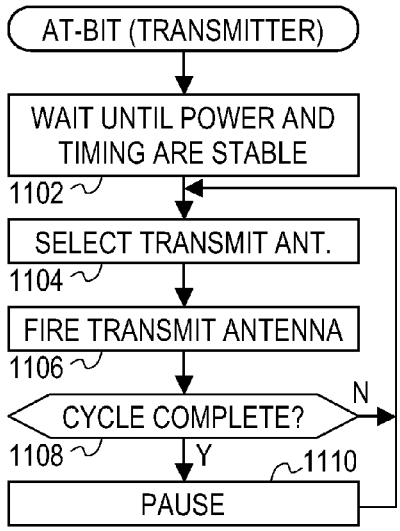

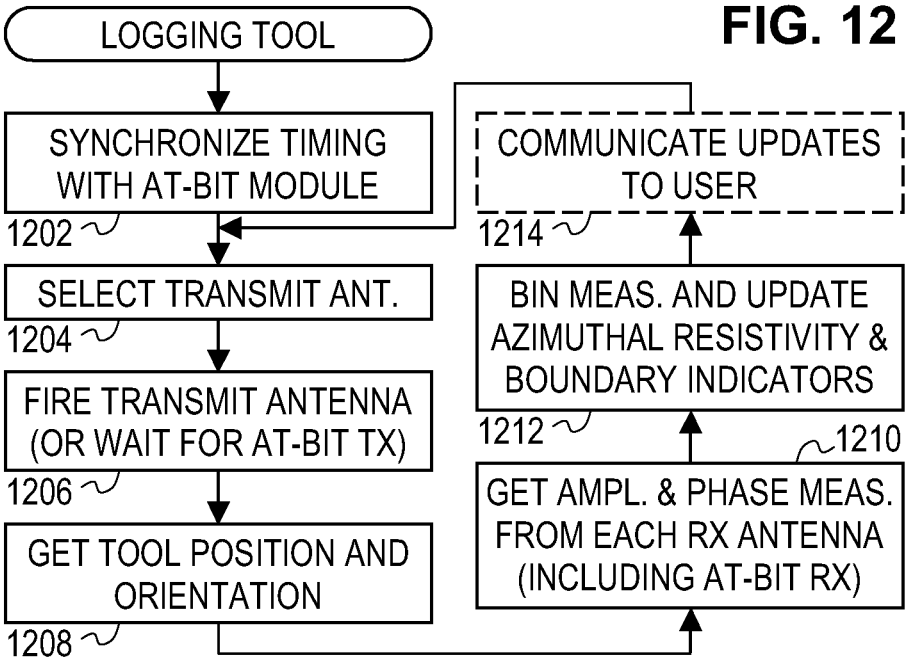
FIG. 12
LOGGING TOOL
SYNCHRONIZE TIMING WITH AT-BIT MODULE
1202
SELECT TRANSMIT ANT.
1204
FIRE TRANSMIT ANTENNA (OR WAIT FOR AT-BIT TX)
1206
GET TOOL POSITION AND ORIENTATION
1208
GET AMPL. & PHASE MEAS. FROM EACH RX ANTENNA (INCLUDING AT-BIT RX)
1210
BIN MEAS. AND UPDATE AZIMUTHAL RESISTIVITY & BOUNDARY INDICATORS
1212
COMMUNICATE UPDATES TO USER
1214

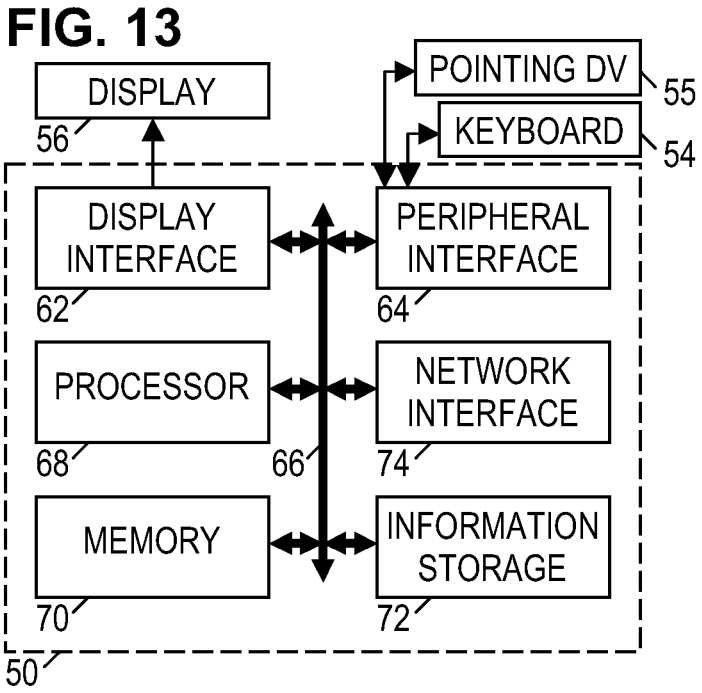
FIG. 13
DISPLAY
56
POINTING DV
55
KEYBOARD
54
DISPLAY INTERFACE
62
PERIPHERAL INTERFACE
64
PROCESSOR
68
66
NETWORK INTERFACE
74
MEMORY
70
INFORMATION STORAGE
72
50

DOWNHOLE METHODS AND ASSEMBLIES EMPLOYING AN AT-BIT ANTENNA

CROSS-REFERENCE

The present application relates to co-pending U.S. patent application Ser. No. 11/835,619, entitled "Tool for Azimuthal Resistivity Measurement and Bed Boundary Detection", and filed Aug. 8, 2007 by inventor Michael Bittar. It also relates to co-pending PCT Application No. PCT/US07/15806, entitled "Modular Geosteering Tool Assembly", and filed Jul. 11, 2007 by inventors Michael Bittar, Clive Menezes, and Martin Paulk. Each of these references is hereby incorporated herein by reference in their entireties.

BACKGROUND

Modern petroleum drilling and production operations demand a great quantity of information relating to the parameters and conditions downhole. Such information typically includes the location and orientation of the borehole and drilling assembly, earth formation properties, and parameters of the downhole drilling environment. The collection of information relating to formation properties and downhole conditions is commonly referred to as "logging", and can be performed during the drilling process itself (hence the term "logging while drilling" or "LWD").

Various measurement tools exist for use in LWD. One such tool is the resistivity tool, which includes one or more antennas for transmitting an electromagnetic signal into the formation and one or more antennas for receiving a formation response. When operated at low frequencies, the resistivity tool may be called an "induction" tool, and at high frequencies it may be called an electromagnetic wave propagation tool. Though the physical phenomena that dominate the measurement may vary with frequency, the operating principles for the tool are consistent. In some cases, the amplitude and/or the phase of the receive signals are compared to the amplitude and/or phase of the transmit signals to measure the formation resistivity. In other cases, the amplitude and/or phase of the receive signals are compared to each other to measure the formation resistivity.

When plotted as a function of depth or tool position in the borehole, the resistivity tool measurements are termed "logs" or "resistivity logs". Such logs may provide indications of hydrocarbon concentrations and other information useful to drillers and completion engineers. In particular, azimuthally-sensitive logs may provide information useful for steering the drilling assembly because they can inform the driller when a target formation bed has been entered or exited, thereby allowing modifications to the drilling program that will provide much more value and higher success than would be the case using only seismic data. However, the utility of such logs is often impaired by the latency between a drill-bit's penetration of a bed boundary and the collection of log information sufficient to alert the driller to that event.

BRIEF DESCRIPTION OF THE DRAWINGS

A better understanding of the various disclosed embodiments can be obtained when the following detailed description is considered in conjunction with the attached drawings, in which:

FIG. 1 shows an illustrative logging while drilling (LWD) environment;

FIG. 2 shows an illustrative bottom-hole assembly with an at-bit antenna;

FIGS. 3A-3F show alternative at-bit antenna configurations;

FIG. 4 shows a cross-section of an illustrative at-bit module;

FIG. 5 is a block diagram of illustrative electronics for a bottom-hole assembly;

FIG. 6 is a block diagram of electronics for an illustrative at-bit module;

FIG. 7 shows an illustrative azimuthal bin arrangement;

FIG. 8 shows an illustrative logging instrument path through a model formation;

FIG. 9 is a graph of illustrative bed boundary indicators;

FIG. 10 is a flow diagram of an illustrative method for an at-bit receiver module;

FIG. 11 is a flow diagram of an illustrative method for an at-bit transmitter module;

FIG. 12 is a flow diagram of an illustrative method for a LWD resistivity tool having an at-bit component; and FIG. 13 is a block diagram of an illustrative surface processing facility.

The following description has broad application. Each disclosed embodiment and accompanying discussion is meant only to be illustrative of that embodiment, and is not intended to suggest that the scope of the disclosure, including the claims, is limited to that embodiment. To the contrary, the intention is to cover all modifications, equivalents and alternatives falling within the spirit and scope of the invention as defined by the appended claims.

DETAILED DESCRIPTION

Disclosed herein are logging tools and methods that employ an at-bit loop antenna to acquire azimuthal resistivity measurements proximate to the bit, thereby enabling low-latency geosteering signals to be generated. In some embodiments, the at-bit antenna is part of a bottom hole assembly that includes a drill bit, a mud motor, and a resistivity tool. The at-bit antenna is a loop antenna that is positioned within three feet of the drill bit's cutting face. The mud motor is positioned between the at-bit antenna and the resistivity tool, and it turns the drill bit via a drive shaft. The resistivity tool includes at least one loop antenna that is not parallel to the at-bit loop antenna. The difference in loop antenna orientations is preferably 30° or more. The at-bit antenna is part of an at-bit module that, in some embodiments, transmits periodic electromagnetic signal pulses for the resistivity tool to measure. In other embodiments, the at-bit module measures characteristics of electromagnetic signal pulses sent by the resistivity tool and communicates the measured characteristics to the resistivity tool via a short hop telemetry link. In this way, the resistivity tool cooperates with the at-bit module to obtain azimuthal resistivity measurements near the bit, from which a bed boundary indicator signal can be calculated and displayed to a user.

The disclosed logging tools and methods are best understood in the context of the larger systems in which they operate. Accordingly, FIG. 1 shows an illustrative logging-while-drilling ("LWD") environment. A drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As bit 14 rotates, it creates a borehole 16 that passes through various formations. A pump 18 circulates drilling fluid 20 through a feed pipe 22, through the interior of the drill string 8 to drill bit 14. The fluid exits through orifices in the drill bit 14 and flows upward through the annulus around the drill string 8 to transport drill cuttings to the surface, where the fluid is filtered and recirculated.

The drill bit 14 is just one piece of a bottom-hole assembly 24 that includes a mud motor and one or more "drill collars" (thick-walled steel pipe) that provide weight and rigidity to aid the drilling process. Some of these drill collars include built-in logging instruments to gather measurements of various drilling parameters such as position, orientation, weight-on-bit, borehole diameter, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. Such orientation measurements can be combined with gyroscopic or inertial measurements to accurately track tool position.

Also included in bottom hole assembly 24 is a telemetry sub that maintains a communications link with the surface. Mud pulse telemetry is one common telemetry technique for transferring tool measurements to surface receivers and receiving commands from the surface, but other telemetry techniques can also be used. For some techniques (e.g., through-wall acoustic signaling) the drill string 8 includes one or more repeaters 30 to detect, amplify, and re-transmit the signal. At the surface, transducers 28 convert signals between mechanical and electrical form, enabling a network interface module 36 to receive the uplink signal from the telemetry sub and (at least in some embodiments) transmit a downlink signal to the telemetry sub. A data processing system 50 receives a digital telemetry signal, demodulates the signal, and displays the tool data or well logs to a user. Software (represented in FIG. 1 as information storage media 52) governs the operation of system 50. A user interacts with system 50 and its software 52 via one or more input devices 54 and one or more output devices 56. In some system embodiments, a driller employs the system to make geosteering decisions and communicate appropriate commands to the bottom hole assembly 24.

FIG. 2 shows an illustrative bottom hole assembly 24 having a drill bit 202 seated in a bit box 204 at the end of a "bent sub" 208. A mud motor 210 is connected to the bent sub 208 to turn an internal driveshaft extending through the bent sub 208 to the bit box 204. The bottom hole assembly further includes a logging while drilling (LWD) assembly 212 and a telemetry sub 218, along with other optional drill collars 220 suspended from a string of drill pipe 222.

The drill bit shown in FIG. 2 is a roller cone bit, but other bit types can be readily employed. Most drill bits have a threaded pin 316 (FIGS. 3D-3F) that engages a threaded socket in a bit box 204 to secures the bit to the drill string. In the embodiment of FIG. 2, the bit box is provided with two loop antennas 206 that work cooperatively with antennas 214, 216 in the LWD assembly 212. As discussed in further detail below, this antenna arrangement enables azimuthal resistivity measurements to be made in close proximity to the bit. The bit box 204 is turned by mud motor 210 via an internal drive shaft passing through the bent sub 208, which is a short section that is slightly bent to enable the drill bit to drill a curved hole when the bit is turned only by the mud motor (i.e., without rotation of the drill string 8). Various types of mud motors can be employed for geosteering, e.g., positive displacement motors (PDM), Moineau motors, turbine-type motors and the like, and those motors employing rotary steerable mechanisms.

LWD assembly 212 includes one or more logging tools and systems capable of recording data as well as transmitting data to the surface via the telemetry via 218. As specifically discussed hereinbelow, the LWD assembly 212 includes a resistivity tool having antennas 214, 216 that work cooperatively with antennas near the bit to determine azimuthal resistivity measurements helpful for geosteering. Because of the length of the mud motor, the resistivity tool sensors located in the LWD section are at least 15 feet from the drilling bit, which would normally imply that the azimuthal resistivity measurements available to the driller apply to a drill bit position at least 15 feet behind the current drill bit position. However, with the cooperation of the at-bit loop antennas, the driller can be provided information applicable to the current drill bit position, making it possible to steer the drilling assembly much more precisely than before.

FIG. 2 shows two loop antennas coaxial with the bit box and axially spaced apart by 15-30 cm. The advantage to placing antennas on the bit box is that this configuration does not require any modification of the drill bits, which are consumable items that need to be regularly replaced. The disadvantage to placing antennas on the bit box is that locations on the drill bit are more proximate to the face of the drill bit. Nevertheless, both configurations are contemplated here, as is the use of a short sub between the bit box and the drill bit, which offers the advantage of enabling the disclosed methods to be used with existing products.

FIG. 3A shows the drill bit 202 secured into a bit box 302 having a tilted loop antenna 304, i.e., a loop antenna having its axis set at an angle with respect to the axis of the bit box. If space allows, a second loop antenna may be provided parallel to the first. Conversely, if space is limited on the bit box, a single co-axial loop antenna 308 may be provided on the bit box 306 as shown in FIG. 3B. The loop antenna(s) does not necessarily need to encircle the bit box. For example, FIG. 3C shows a bit box 310 having a loop antenna 312 with an axis that is perpendicular to the long axis of the bottom hole assembly.

FIGS. 3D-3F show drill bits having embedded loop antennas. In FIG. 3D, drill bit 314 has a normal-length shaft 318 to support a co-axial loop antenna 318, which can be contrasted with drill bit 320 in FIG. 3E. Drill bit 320 has an elongated shaft 322 to support a tilted antenna 324. In FIG. 3F, a drill bit 326 is provided with a co-axial loop antenna 328 on its gauge surface. (Most bent sub and rotary steerable systems employ long gauge bits, i.e. bits having gauge surfaces that extend axially for 10 cm or more and conveniently provide space for embedding sensors in the bit surface.) As discussed further below, some embodiments employ the at-bit loop antennas as transmit antennas while other embodiments employ the at-bit antennas as receive antennas.

FIG. 4 shows a cross-section of bit box 204, which is connected to an internal shaft 402 extending through the bent sub 208. Drilling fluid flows via passage 404 into the pin end of the drill bit below. Electronics in compartment 406 couple to the loop antennas 206 via wiring passages 408. Electronics 406 derive power from batteries, a vibration energy harvester, a turbine in flow passage 404, or wire loops in compartment 406 that pass through magnetic fields of magnets in the outer shell of bent sub 208 as the internal shaft rotates. (As indicated at 206', the at-bit antenna may alternatively be mounted to the shell proximate to the bit box.) In some system embodiments, the electronics use this power to drive timed sinusoidal pulses through each loop antenna in turn, with pauses for the operation of other transmit antennas in the system. In other system embodiments, the electronics use this power to establish a short hop communications link to the LWD assembly above the mud motor. Various existing short-hop downhole communications techniques are suitable and can be employed. For example, U.S. Pat. No. 5,160,925 to Dailey, entitled "Short hop communication link for downhole MWD system" discloses an electromagnetic technique; U.S. Pat. No. 6,464,011 to Tubel, entitled "Production well telemetry system" discloses an acoustic technique; U.S. Pat. No. 7,084,782 to Davies, entitled "Drill string telemetry system and method" discloses an axial current loop technique; and U.S. Pat. No. 7,303,007 to Konschuh, entitled "Method and apparatus for transmitting sensor response data and power through a mud motor" discloses a wired technique. With a short-hop communications loop in place, the electronics can synchronize timing with the LWD assembly, measure receive signal amplitudes and phases, and communicate those measurements to the LWD assembly for further processing. In some tool embodiments, one of the loop antennas function as a transmit and receive antenna for short hop communications, and further operates as a transmit or receive antenna for resistivity measurements.

FIG. 5 is a block diagram of illustrative electronics for a bottom-hole assembly. A telemetry module 502 communicates with a surface data processing facility to provide logging data and to receive control messages for the LWD assembly and possibly for steering the drilling assembly. A control module 504 for the LWD assembly provides the logging data and receives these control messages. The control module 504 coordinates the operation of the various components of the LWD assembly via a tool bus 506. These components include a power module 508, a storage module 510, an optional short hop telemetry module 512, and a resistivity logging tool 514. In some embodiments, at-bit instruments 516 send electromagnetic signals 518 that are used by logging tool 514 to measure azimuthal resistivity. In other embodiments, logging tool 514 sends electromagnetic signals 520 that are measured by at-bit instruments 516 and communicated via short hop telemetry module 512 to the resistivity logging tool 514 for azimuthal resistivity calculations. The control module 504 stores the azimuthal resistivity calculations in storage module 510 and communicates at least some of these calculations to the surface processing facility.

FIG. 6 is a block diagram of electronics for an illustrative at-bit instrumentation module 516. The illustrative module includes a controller and memory unit 602, a power source 604, one or more antennas for transmitting and optionally receiving electromagnetic signals, an optional short hop telemetry transducer 608, and other optional sensors 610. Controller and memory unit 602 controls the operation of the other module components in accordance with the methods described below with reference to FIGS. 9 and 10. Power source 604 powers the other module components from batteries, a vibration energy harvester, a turbine, an electrical generator, or another suitable mechanism. Antennas 606 are loop antennas that couple to controller 602 to transmit or receive electromagnetic signals. Short hop telemetry transducer 608 communicates with short hop telemetry module 512 (FIG. 5) using any suitable short hop downhole communications technique. Other sensors 610 may include temperature, pressure, lubrication, vibration, strain, and density sensors to monitor drilling conditions at the bit.

Before describing the methods for making at-bit azimuthal resistivity measurements, it is helpful to provide some further context. FIG. 7 shows an example of how a borehole can be divided into azimuthal bins (i.e., rotational angle ranges). In FIG. 7, the circumference has been divided into eight bins numbered 702, 704, . . . , 716. Of course, larger or smaller numbers of bins can be employed. The rotational angle is measured from the high side of the borehole (except in vertical boreholes, where the rotational angle is measured relative to the north side of the borehole). As a rotating tool gathers azimuthally sensitive measurements, the measurements can be associated with one of these bins and with a depth value. Typically LWD tools rotate much faster than they progress along the borehole, so that each bin at a given depth can be associated with a large number of measurements. Within each bin at a given depth, these measurements can be combined (e.g., averaged) to improve their reliability.

FIG. 8 shows an illustrative resistivity logging tool 802 passing at an angle through a model formation. The model formation includes a 20 ohm-meter bed 806 sandwiched between two thick 1 ohm-meter beds 804, 808. The illustrative resistivity tool makes azimuthally sensitive resistivity measurements from which a boundary indication signal can be determined. As explained further below, the bed boundary indication signal can be based on a difference or ratio between measurements at opposite azimuthal angles.

FIG. 9 is a graph of illustrative bed boundary indication signals at opposite azimuthal orientations derived from the model in FIG. 8. Signal 902 is an illustrative boundary indication signal for a downward orientation ($\alpha$=180°) and signal 904 is the corresponding boundary indication signal for an upward orientation ($\alpha$=0°). Signals 902 and 904 positive when the tool is near a boundary and is oriented towards the bed having a higher resistivity. They are negative when the tool is near a boundary and is oriented towards the bed having a lower resistivity. Thus, a driller can steer a tool in the direction of the largest positive boundary indication signal to maintain the borehole in a high resistivity bed. Such boundary indication signals can be derived using one of the methods of FIG. 10 or 11 in combination with the method of FIG. 12.

FIG. 10 shows an illustrative method that can be implemented by an at-bit receiver module. Beginning with block 1002, the receiver module synchronizes itself with the LWD assembly. In some embodiments, this synchronization occurs via a round-trip communication exchange to determine a communications latency, which can then be applied as a correction to a current time value communicated from the LWD assembly to the at-bit module. In other embodiments, high timing accuracy is not required and this block can be omitted.

In block 1004, the at-bit module detects pulses in the receive signal and measures their amplitude and phase. Such measurements are performed simultaneously for all receiver antennas, and the timing for such measurements can be set by the LWD assembly via short hop telemetry. In block 1006, the amplitude and phase measurements for each receive signal pulse are time stamped and communicated to the LWD assembly. In some embodiments phase differences and attenuation values between receive antennas are calculated and communicated to the LWD assembly. In at-bit modules having tilted antennas, the rotational orientation of the at-bit module is measured and communicated to the LWD assembly together with the amplitude and phase measurements. The method repeats beginning with block 1004.

FIG. 11 shows an illustrative method that con be implemented by an at-bit transmitter module. Once power is supplied to the at-bit module in block 1102, the module undergoes a wait period that lasts until the module determines the power supply has stabilized and the timing reference jitter has an adequately small value. In block 1104, the module begins iterating through at-bit loop antennas. In block 1106, the module fires the transmit antenna by driving a sinusoidal pulse through it, e.g., a 100 microsecond 2 MHz pulse. (Pulse lengths can be varied up to about 10 milliseconds. Signal frequency can vary from about 10 kHz to about 10 MHz.) In block 1108, the module checks to determine whether each of the transmit antennas has been fired. If not, the module selects and fires the next antenna, beginning again in block 1104. Otherwise, the module pauses in block 1110 before returning to block 1104 to repeat the entire cycle. This pause provides space for other transmitter firings (e.g., the transmitters in the LWD assembly) to occur and provides time for the tool to change position before the next cycle. In some embodiments, one or more of the transmit pulses can be modulated to communicate information from other at-bit sensors to the LWD assembly.

FIG. 12 shows an illustrative method for a LWD resistivity tool having an at-bit component. Beginning in block 1202, the tool synchronizes its time reference with the at-bit module. In at least some embodiments using the at-bit transmitter, the tool detects signal pulses from the at-bit transmitter, identifies the pause and pulse frequencies, and determines a cycle period and a cycle start time. The transmitter-based timing information can be used as a reference for subsequent resistivity tool operations. In embodiments using the at-bit receiver, the tool engages in short hop communications with the at-bit module to coordinate timing and in some cases to estimate a communications lag which can be used as a offset to accurately synchronize the timing references of the tool and the at-bit module.

Note that in the antenna arrangement formed by the combination of resistivity tool antennas and at-bit antennas, there may be multiple transmit antennas. In most cases, the transmit antennas are fired sequentially and the response of each receiver antenna to each transmit antenna firing is measured. A measurement cycle includes a firing of each transmit antenna. Having synchronized the timing of the two modules in block 1202, the tool in block 1204 begins iterating through each of the transmit antennas, selecting one at a time.

Though the next three blocks are shown and described sequentially, their actual execution is expected to occur concurrently. In block 1206, the tool transmits a pulse from the selected transmit antenna into the surrounding formation or, if the transmit antenna is an at-bit antenna, the tool expects the at-bit module to transmit the pulse. At the same time the transmit antenna is fired, the tool measures the current tool position and orientation in block 1208. In block 1210, the tool (and at-bit module) measure the amplitude and phase of signals received by each of the receiver antennas. At-bit measurements are communicated to the resistivity tool via the short-hop telemetry link. In block 1212, the measured response amplitudes and phases to each transmitter are associated with a measurement bin defined for the current tool position and orientation. The measurements for each transmi-receive antenna pair in that bin are combined to improve measurement accuracy, and from the combined measurements an azimuthal resistivity measurement is formed and updated as new measurements become available. Similarly, boundary indication values are determined for each bin. In optional block 1214, at least some of the resistivity and/or boundary indicator values are communicated via an uphole telemetry link to a surface processing facility for display to a user.

In block 1212, a resistivity measurement and a bed boundary indicator measurement are determined or updated for the bin based on the new amplitude and phase measurement and any previous measurements in that bin. Due to the use of non-parallel transmit and receive antennas (e.g., either the transmitter or receiver is tilted), the resistivity measurements are azimuthally sensitive. In some embodiments, the resistivity measurements are determined from the average compensated amplitude and phase measurement of the current bin, possibly in combination with the average compensated measurements for other nearby bins and other measured or estimated formation parameters such as formation strike, dip, and anisotropy. Compensated measurements are determined by averaging measurements resulting from symmetrically spaced transmitters.

The bed boundary indicator calculations for a bin may be based on a measurement of a non-parallel transmit-receive antenna measurement with either an at-bit transmit antenna or an at-bit receive antenna, e.g., antennas 206 and 214 in FIG. 2. (For the present discussion, we assume only one at-bit antenna is being used. The usage of multiple at-bit antennas is discussed further below.) For example, if, given the measurements in a bin, the average measured signal phase of antenna 214 in response to the signal transmitted by antenna 206 (or conversely, the phase of antenna 206 in response to a signal from antenna 214) is Φ, the bed boundary indicator for this bin may be calculated as:

$$I=(\Phi \text{ in the current bin})-(\Phi \text{ in the bin } 180^\circ \text{ from current bin}) \quad (1)$$

Thus, with reference to FIG. 7, the bed boundary indicator for bin 702 may calculated from the difference in average measured signal phase between bins 702 and 710. The bed boundary indicator for bin 704 may be calculated using a difference between phase measurements for bins 704 and 712. Alternatively, a difference in logarithms of amplitude A (or attenuation) of receiver antenna 214's response relative to the transmit antenna 206 signal between these bins may be used instead of phase differences:

$$I=\ln(A \text{ in the current bin})-\ln(A \text{ in the bin } 180^\circ \text{ from current bin}) \quad (2)$$

As yet another alternative, rather than taking a difference between phase or log amplitude of bins 180° apart, the difference may be determined between the phase (or log amplitude) for the current bin and the average phase (or log amplitude) for all the bins at a given axial position in the borehole:

$$I = (\Phi \text{ in bin}(k, z)) - \frac{1}{n}\sum_{i=1-n} (\Phi \text{ in bin}(i, z)) \quad (3)$$

$$I = \ln(A \text{ in bin}(k, z)) - \frac{1}{n}\sum_{i=1-n} \ln(A \text{ in bin}(i, z)) \quad (4)$$

where bin(k,z) is the bin at the kth rotational orientation at the zth position in the borehole. It is likely that measurements can be repeated many times for each bin and the phase/amplitude values used are actually averages of these repeated measurements.

We note that FIG. 2 shows the presence of two at-bit antennas 206. If, in response to a signal from antenna 214, the average phase measured by one of these antennas is $\Phi_1$ and the average phase measured by the other is $\Phi_2$ (or conversely, these are the phases measured by antenna 214 in response to the two at-bit antennas 206), a more focused bed boundary indicator can be calculated from the phase difference, e.g.:

$$\delta = \Phi_1 - \Phi_2 \tag{5}$$

$$I = (\delta \text{ in the current bin}) - (\delta \text{ in the bin } 180^\circ \text{ from current bin}) \tag{6}$$

or $$I = (\delta \text{ in bin}(k, z)) - \frac{1}{n}\sum_{i=1-n} (\delta \text{ in bin}(i, z)) \tag{7}$$

Similar indicators based on the logarithms of signal amplitudes can be calculated.

FIG. 13 is a block diagram of an illustrative surface processing facility suitable for collecting, processing, and displaying logging data. In some embodiments, the facility generates geosteering signals from the logging data measurements and displays them to a user. In some embodiments, a user may further interact with the system to send commands to the bottom hole assembly to adjust its operation in response to the received data. If desired, the system can be programmed to send such commands automatically in response to the logging data measurements, thereby enabling the system to serve as an autopilot for the drilling process.

The system of FIG. 13 can take the form of a desktop computer that includes a chassis 50, a display 56, and one or more input devices 54, 55. Located in the chassis 50 is a display interface 62, a peripheral interface 64, a bus 66, a processor 68, a memory 70, an information storage device 72, and a network interface 74. Bus 66 interconnects the various elements of the computer and transports their communications. The network interface 74 couples the system to telemetry transducers that enable the system to communicate with the bottom hole assembly. In accordance with user input received via peripheral interface 54 and program instructions from memory 70 and/or information storage device 72, the processor processes the received telemetry information received via network interface 74 to construct formation property logs and/or geosteering signals and display them to the user.

The processor 68, and hence the system as a whole, generally operates in accordance with one or more programs stored on an information storage medium (e.g., in information storage device 72). Similarly, the bottom hole assembly control module 504 (FIG. 5) operates in accordance with one or more programs stored in an internal memory. One or more of these programs configures the control module and processing system to carry out at least one of the at-bit logging and geosteering methods disclosed herein.

Numerous variations and modifications will become apparent to those skilled in the art once the above disclosure is fully appreciated. It is intended that the following claims be interpreted to embrace all such variations and modifications.

In some embodiments, at-bit transmitter modules automatically transmit periodic high frequency signal pulses without any need for control signals beyond simple on/off state changes which can automatically triggered by detection of drilling activity. To obtain the measurements necessary for boundary detection, it is preferred to have non-parallel transmitter-receiver pairs with a relative tilt angle of at least 30° and more preferably about 45°. For example, if the transmitter coil at the bit is co-axial, the receiver coil should be tilted. Conversely, if the receiver coil is coaxial, the transmitter coil should be tilted. Although the figures show the at-bit antenna embedded on the bit or on the bit box, the at-bit antenna could alternatively be located on the bent sub directly adjacent to the bit box.

What is claimed is:

1. A bottom hole assembly that comprises:

a drill bit having a cutting face;

a resistivity tool having at least one loop antenna;

a mud motor coupled to the drill bit via a drive shaft, wherein the mud motor is positioned between the drill bit and the resistivity tool; and an at-bit receiver antenna, wherein the at-bit receiver antenna is a loop antenna positioned between the mud motor and the cutting face, and wherein the at-bit receiver antenna is not parallel to the resistivity tool's loop antenna;

wherein the resistivity tool is adapted to synchronize timing with an at-bit module and to make periodic measurements of the attenuation and phase shift of electromagnetic signals passing between the at-bit antenna and the tool's loop antenna.

2. The assembly of claim 1, wherein the at-bit receiver antenna is co-axial with the bit.

3. The assembly of claim 1, wherein the at-bit receiver antenna has an axis that is tilted relative to the bit axis.

4. The assembly of claim 1, wherein the at-bit receiver antenna has an axis that is perpendicular to the bit axis.

5. The assembly of claim 1, wherein the difference in at-bit receiver antenna orientation and tool loop antenna orientation is at least 30°.

6. The assembly of claim 5, wherein the tool's loop antenna transmits electromagnetic signal pulses for the at-bit antenna to receive, wherein an at-bit module communicates measurements of the electromagnetic signal pulse characteristics via short-hop telemetry to the resistivity tool.

7. The assembly of claim 1, wherein the at-bit receiver antenna is embedded on a gauge surface of the drill bit.

8. The assembly of claim 1, wherein the at-bit receiver antenna is embedded on a shaft of the drill bit.

9. The assembly of claim 1, wherein the drill bit includes a pin end threaded into a bit box upon which is mounted the at-bit receiver antenna.

10. The assembly of claim 1, wherein the drive shaft passes through a shell, and wherein the at-bit receiver antenna is mounted to the shell proximate to a bit box.

11. The assembly of claim 1, wherein the resistivity tool determines an azimuthal dependence of formation resistivity, and wherein the azimuthal dependence is communicated to a user as a bed boundary indicator signal.

12. The assembly of claim 1, further comprising a second at-bit receiver antenna that is a loop antenna positioned between the mud motor and the cutting face.

13. A logging method that comprises:

synchronizing a time reference for an at-bit loop antenna with a resitivity tool positioned on an opposite side of a mud motor;

transmitting electromagnetic pulses from said at-bit loop antenna to said resistivity tool;

measuring characteristics of the electromagnetic pulses with a loop antenna on the resistivity tool, wherein at least one of the at-bit loop antenna and the tool loop antenna are co-axial while the other is tilted;

associating the measured characteristics with an azimuthal orientation of at least one of the loop antennas;

determining a resistivity value based at least in part on the measured characteristics; and providing a boundary indicator signal based at least in part on azimuthal variation of the resistivity value.

14. The logging method of claim 13, wherein the at-bit loop antenna is co-axial and the tool loop antenna is tilted.

15. The logging method of claim 13, wherein the difference between the orientations of the loop antennas is at least 30°.

16. The logging method of claim 13, further comprising transmitting electromagnetic pulses from a second, different at-bit loop antenna and measuring characteristics of these electromagnetic pulses with the loop antenna on the resistivity tool, wherein the resistivity value is also based in part on the measured characteristics of electromagnetic pulses from the second at-bit loop antenna.

17. A logging method that comprises:

synchronizing a time reference for a loop antenna on a resistivity tool with an at-bit loop antenna positioned on an opposite side of a mud motor;

transmitting electromagnetic pulses from said loop antenna to said at-bit loop antenna measuring characteristics of the electromagnetic pulses with the at-bit loop antenna;

communicating the measured characteristics via short hop telemetry to the resistivity tool, wherein the measured characteristics are associated with an azimuthal orientation of at least one of the loop antennas;

determining a resistivity value based at least in part on the measured characteristics; and providing a boundary indicator signal based at least in part on azimuthal variation of the resistivity value.

18. The logging method of claim 17, wherein the at-bit loop antenna is co-axial and the tool loop antenna is tilted by at least 30°.

19. The logging method of claim 17, further comprising measuring characteristics of the electromagnetic pulses with a second, different at-bit loop antenna, wherein the resistivity value is also based in part on the measured characteristics of electromagnetic pulses from the second at-bit loop antenna.

20. A bottom hole assembly that comprises:

a drill bit having a cutting face;

a resistivity tool having at least one loop antenna;

a mud motor coupled to the drill bit via a drive shaft, wherein the mud motor is positioned between the drill bit and the resistivity tool; and an at-bit antenna, wherein the at-bit antenna is a loop antenna positioned within three feet of the cutting face, and wherein the at-bit antenna is not parallel to the tool's loop antenna, wherein the resistivity tool synchronizes timing with an at-bit module so as to make periodic measurements of the attenuation and phase shift of electromagnetic signals passing between the at-bit antenna and the tool's loop antenna.

* * * * *